US005785327A

United States Patent [19]

Gallant

[11] Patent Number: 5,785,327

[45] Date of Patent: Jul. 28, 1998

[54] SKATES HAVING RETRACTABLE ROLLERS

[76] Inventor: Raymond J. Gallant, 443 Kawaihae St., Honolulu, Hi. 96825

[21] Appl. No.: 878,674

[22] Filed: Jun. 20, 1997

[51] Int. Cl.[6] ..... A63C 17/00

[52] U.S. Cl. ..... 280/11.27; 280/11.23

[58] Field of Search ..... 280/11.19, 11.2, 280/11.22, 11.23, 11.26, 11.27, 11.28, 87.041, 87.042

[56] References Cited

U.S. PATENT DOCUMENTS 3,884,485 5/1975 Wälle .
4,150,499 4/1979 Wang .
5,286,043 2/1994 Tkacyk .
5,398,950 3/1995 Tkacyk .
5,398,970 3/1995 Tucky .

*Primary Examiner*—Richard M. Camby
*Attorney, Agent, or Firm*—Terrance L. Siemens

[57] ABSTRACT

A skate having simultaneously retracted front and rear wheels. A retraction mechanism mounted below the show includes a linkage member yoked to all wheels. The retraction member includes cams or ramps which guide the wheels to move in an inclined direction, thereby retracting into the housing of the retraction mechanism and extending below the housing. When retracted, only the flat bottom surface of the housing is exposed below the housing. A linkage member rotated by a key disposed at the heel of the shoe moves the wheels along the ramps in tandem.

9 Claims, 2 Drawing Sheets

SKATES HAVING RETRACTABLE ROLLERS

BACKGROUND OF THE INVENTION

1. Field of the Invention

The present invention relates to athletic equipment, and more particularly to roller skates. The novel skates have front and rear trucks which may be retracted into the body of the skate. A cam driven linkage connects to both trucks.

2. Description of the Prior Art

Roller skates and similar athletic equipment have rolling or sliding surfaces provided for interacting with the ground or other supporting environmental surface. This component of skates adds bulk to the overall volume, and is also somewhat impractical when the user must negotiate surfaces not suited to the roller wheel or blade. There are numerous examples of floors or other environmental surfaces on which use of the skate is forbidden or is nearly impossible. Finished floor surfaces such as marble provide an example of the former. Sand, gravel, and soft turf exemplify the latter.

U.S. Pat. No. 3,884,485, issued to Josua Wälle on May 20, 1975, and U.S. Pat. No. 5,398,970, issued to Edward W. Tucky on Mar. 21, 1995, illustrate skates having wheels which are movable to deployed and retracted positions within the skate. However, there is no mechanism in either case for linking front and rear wheels or the blade to retract and extend both simultaneously, as found in the present invention. There is also no mechanism for utilizing the wheels or blade in a partially retracted position, as also seen in the present invention.

U.S. Pat. Nos. 5,286,043 and 5,398,950, issued to John Tkaczyk respectively on Feb. 15, 1994 and Mar. 21, 1995, illustrated a single retractable wheel disposed between front and rear principal wheels. obviously, there is no simultaneous retraction and extension of two wheels in the inventions of Tkackyz, nor is there operability of a wheel in a partially retracted position.

U.S. Pat. No. 4,150,499, issued to Tec T. T. Wang on Apr. 24, 1979, describes a shoe having entirely removable roller wheels. These wheels are fully separated from the associated shoe, and thus are not retractable. There is no provision for adjusting position of the wheels to be operable in a partially removed position.

None of the above inventions and patents, taken either singly or in combination, is seen to describe the instant invention as claimed.

SUMMARY OF THE INVENTION

The present invention provides skates wherein the rollers or wheels are retractable into a stowed position. A common linkage controls both front and rear wheels such that all wheels are retracted or extended into a deployed position simultaneously. The linkage is operated by a key located inconspicuously and unobtrusively at the heel of the shoe. Rotation of the key moves the linkage forwardly and backwardly. The wheels are yoked or similarly connected to the linkage, and thus maintain constant spacing separating front from rear wheels, or otherwise stated, maintain a constant wheelbase. The wheels are forced to ascend and descend a ramp when the linkage is moved. Forward movement of the linkage retracts the wheels and rearward movement extends the wheels.

The wheels thereby ascend relative to their surrounding supporting structure into a retracted position and can be made to descend therefrom by reversing direction of rotation of the key. When retracted, a solid, flat bottom surface of the supporting structure contacts the ground or floor surface, so that the user can walk in normal fashion. When extended, the wheels space the bottom surface above the ground so that only rolling contact with the ground or floor is possible.

A user may thus don the novel skates and negotiate terrain of different surface characteristics without being obliged to remove the skates. It is merely necessary to rotate the key to reconfigure the skates between a retracted position of the wheels and an extended position. A user may thereby alternate between walking, when obliged, and skating, when possible. It is not necessary to bring a separate pair of shoes to wear when skating is not allowed or feasible.

The key may be permanently fixed to the shoe, or may be removable. The bottom surface of the shoe contacting the ground when the wheels are retracted may be a semi-rigid material, such as leather, rubber, or a resilient synthetic resin, so that finished floors will not be marred.

The novel arrangement may be applied to elongated support members as well as to skates having one front wheel and one rear wheel. For example, a horizontal member bearing a plurality of rollers or wheels may be retracted and extended by the novel linkage. Also, sliding support members, such as ice skating blades, may enjoy the benefits of the present invention.

It is further possible to adjust height of the rolling or sliding support member or members when in the extended position. This is possible since solid yoking of two or more points along the member being retracted and extended maintains the member horizontal.

Accordingly, it is a principal object of the invention to provide skates having wheels or rollers which are retractable into a stowed position and extensible into a deployed position.

It is another object of the invention to provide means for retracting and extending the wheels of the skate simultaneously.

It is a further object of the invention to retract and extend the wheels by moving their axles along an inclined ramp.

Still another object of the invention is to maintain the wheels level when being extended and retracted.

An additional object of the invention is to maintain a constant wheel base when extending and retracting the wheels.

It is again an object of the invention to provide an arrangement for retracting and extending wheels which is also applicable to linear arrays of wheels and to ice skating blades.

Yet another object of the invention is to enable a person wearing skates to negotiate surfaces enabling rolling and surfaces requiring walking.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
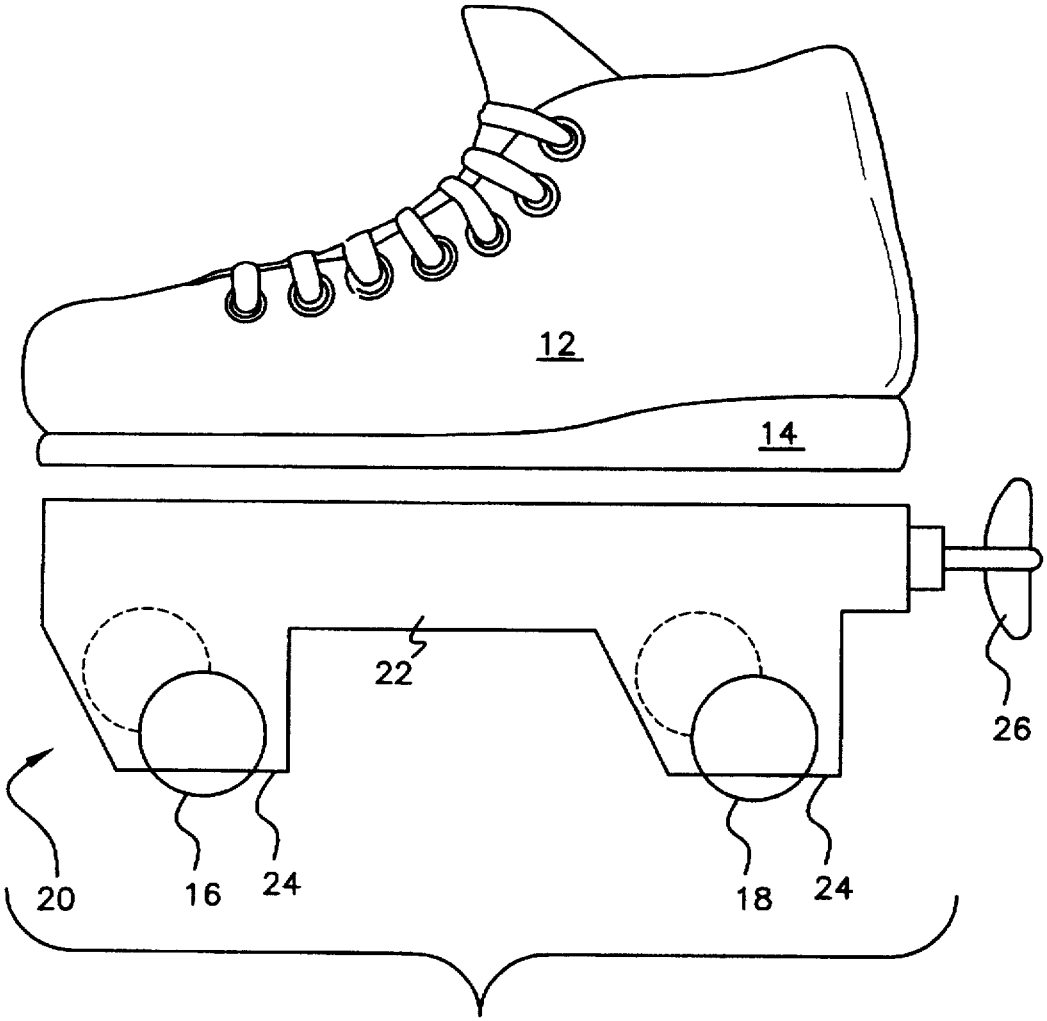
FIG. 1 is a partially exploded, diagrammatic, side elevational view of the novel skate.

Turning now to FIG. 1 of the drawings, novel skate 10 is seen to comprise a shoe 12 having a sole 14, and a plurality of wheels retractably mounted to shoe 12, including front wheel 16 and rear wheel 18. Although only one wheel 16 and one wheel 18 are depicted, each could comprise a wheel assembly (not shown) wherein two or more wheels 16 or 18 are arranged abreast of each other.

A retraction mechanism 20 is mounted to shoe 12 in any suitable way. Retraction mechanism 20 has a housing 22 for surrounding wheels 16, 18. Housing 22 has a bottom surface 24, which is broken or non-continuous in the embodiment depicted. A key 26 for extending wheels 16, 18 into a deployed position wherein wheels 16, 18 are shown in solid lines and into a retracted position wherein wheels 16, 18 are shown in broken lines projects to the exterior of shoe 12 and retraction mechanism 20. This is a location which is accessible by hand, key 26 thus being accessible and unobtrusive.

If plural wheels are provided at the front position or rear position, they may be disposed outside housing 22. It is not critical to the invention that the wheels be enclosed within housing 22. Rather, it is merely necessary that they be supported in a manner to be retracted such that each wheel 16 or 18 is disposed entirely above surface 24 and extended so that part of each wheel 16 or 18 projects below surface 24. Retraction and extension are more fully described hereinafter. It is also important that a fixed, strong portion of retraction mechanism 20 provide surface 24 for contacting the ground and bearing the weight of the user, thereby enabling walking when wheels 16, 18 are retracted. With wheels 16, 18 extended, the user is able to skate.

Figure 2:
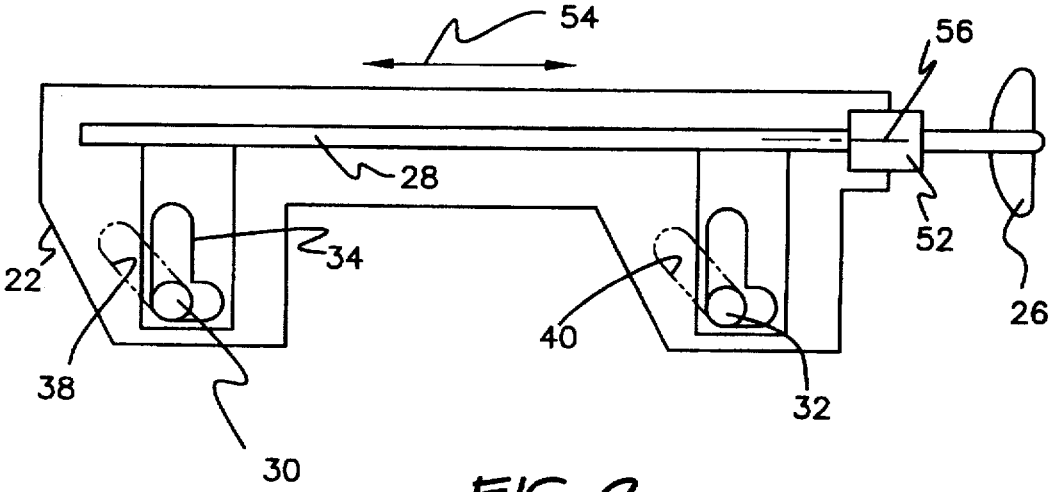
FIG. 2 is a diagrammatic, side elevational view of moving components of the lower part of FIG. 1.

FIG. 2 shows the principal components which extend and retract wheels 16, 18. A linkage member 28 is operably connected to all wheels 16, 18 (see FIG. 1) selectively to retract all wheels 16, 18 simultaneously into the stowed position. Also, linkage member 28 simultaneously extends wheels 16, 18 into the deployed position. Linkage member 28 engages each wheel 16 or 18 by its axle 30 or 32 (respectively) by yokes 34, 36. Axles 30, 32 are arranged so that they ride on respective ramps 38, 40. Ramps 38, 40 each have an upper surface and a lower surface acting in the manner of a cam or an inclined plane to guide axles 30, 32. Ramps 38, 40 are solidly fixed in relation to shoe 12, and guide their respective axles 30, 32 to move along inclined paths having a vertical component of travel and a horizontal component of travel when wheels 16, 18 are moved by retraction mechanism 20.

Yokes 34, 36 and respective ramps 38, 40 cooperate in that each influences it respective axle 30 or 32. Yokes 34, 36 move respective axles 30, 32 horizontally, as shown in FIG. 2. Ramps 38, 40 are fixed in place, and axles 30, 32 must move upwardly on ramps 38, 40 when propelled to the left in FIG. 2 and downwardly on ramps 38, 40 when propelled to the right by yokes 38, 40.

Housing 20 serves the multiple purposes of supporting wheels 16, 18; providing guiding structure in the form of ramps 38, 40; and providing a walking surface in the form of surface 24 when wheels 16, 18 are retracted. It also provides supporting structure securing linkage member 28 in position. This position is preferably horizontal, considered with respect to the longitudinal axis 56 of linkage member 28, so that linkage member 28 is parallel to sole 14 of shoe 12. This arrangement promotes compactness of retraction member 20 as mounted on shoe 12.

Figure 3:
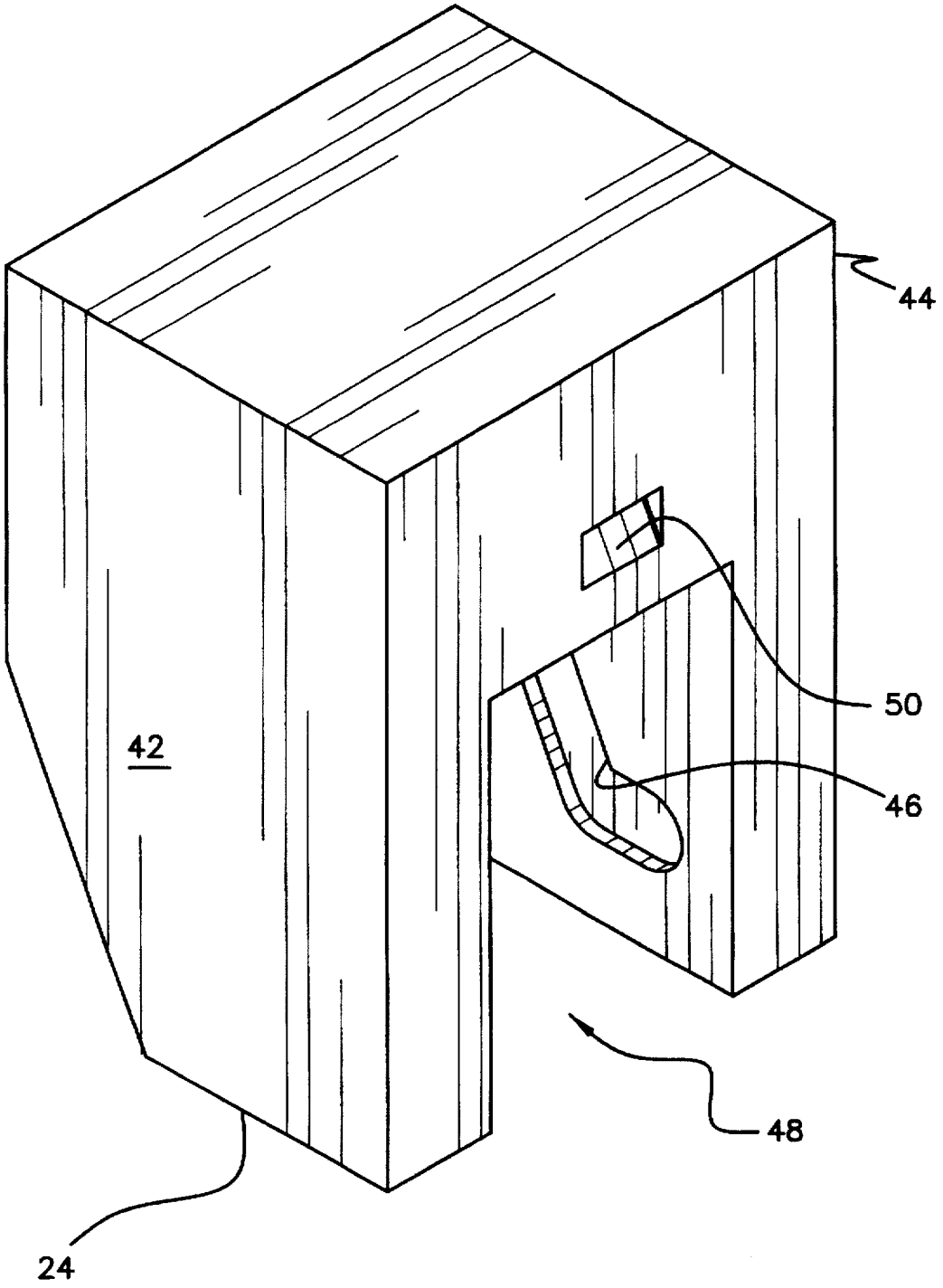
FIG. 3 is a broken away perspective detail view of the component of the invention partially enclosing the moving components shown in FIG. 2.

FIG. 3 provides a further view of one embodiment of housing 20. In this view, it will be seen that housing 20 has lateral walls 42, 44 for supporting an axle 30 or 32 at a ramp 46. Walls 42, 44 define a partially open chamber 48 which encloses a wheel 16 or 18 when retracted, and which allows wheel 16 or 18 to project below surface 24 in the deployed position. In the embodiment depicted, wall 44 closes ramp 46 to the right. A similar enclosed ramp (not visible) is provided in wall 42. In the embodiment of FIG. 3, it is contemplated that a single wheel 16 or 18 will be accommodated. However, wheels arranged abreast (not shown) may be accommodated by removing those portions of walls 42, 44 enclosing their respective ramps, so that the axle of the plural wheels (not shown) may pass to the exterior of walls 42, 44. This arrangement is preferred for maintaining lateral symmetry, so that its associated skate will lack a propensity to be unbalanced or to veer to one side or the other in use. FIG. 3 also illustrates a passageway 50 for supporting linkage member 28 within retraction member 20.

Returning to FIG. 2, retraction mechanism 20 comprises a rotary drive, indicated generally at 52. Rotary drive 52 includes an axially stationary driving element (not separately shown) and an axially displaceable driven element (not separately shown) arranged to move axially responsive to rotation of the driving element and to move linkage member 28 linearly when moved axially. In one embodiment of rotary drive 52, the driving and driven elements comprise a set of worm gears (not separately shown), wherein one gear is permanently or removably connected to key 26 and the other gear is drivably fixed to linkage member 28. A cam or fulcrumed actuation may also be used instead of a set of worm gears. A ball and socket (not shown) or other structure may be provided in rotary drive 52 for reconciling combined axial and rotary motion of the latter gear with purely axial or linear motion of linkage member 28. Linear motion of linkage member 28, indicated by arrow 54, is parallel to axis 56 of its associated gear.

The invention may also be regarded as comprising a retraction mechanism for attachment of a separate shoe, to enable the shoe to be utilized as a skate. Retraction mechanism 20 may be provided apart from, but having apparatus (not shown) for engaging, shoe 12. The apparatus for engaging shoe 12 may comprise straps having fasteners, brackets, clamps (none shown), or the like.

The present invention is susceptible to variations and modifications which may be introduced without departing from the inventive concept. For example, it would be considered an equivalent of the foregoing to make the ramps or cams integral with the linkage member, with axles riding in a slot fixed to housing. This embodiment merely reverses certain fixed and movable parts, but does not change the basic nature of the invention.

The precise arrangement of wheels may be varied to suit, provide there at least two wheels arranged in tandem with one relatively ahead of or to the front of the other. Key 26 may be formed separately and removably from its associated components, if desired. Motion translation from rotation at key 26 to linear movement at linkage member 28 may be by any suitable apparatus. The arrangement of yokes 34, 36 and ramps 38, 40 may be modified to produce similar results.

It will further be appreciated that wheels 16, 18 may be replaced by a blade, such as an ice skating blade, or by a member bearing a linear array of wheels or rollers.

It is to be understood that the present invention is not limited to the embodiments described above, but encompasses any and all embodiments within the scope of the following claims.

I claim:

1. A skate comprising:

a shoe having a sole;

a plurality of retractable wheels retractably mounted to said shoe;

a retraction mechanism mounted to said shoe having a housing for supporting said retractable wheels where said housing has a bottom surface, and where said retraction mechanism includes a linkage member operably connected to all of said retractable wheels and where retraction mechanism comprises a ramp fixed in relation to said shoe and disposed to guide said retractable wheels along an inclined path having a vertical component and a horizontal component of travel; whereby said retractable wheels are simultaneously moved by said linkage member into a deployed position extending below said bottom surface of said housing and, when desired, said linkage member moves said retractable wheels simultaneously into a stowed position above said bottom surface of said housing.

2. The skate according to claim 1, wherein said retraction mechanism comprises a rotary drive having an axially stationary-driving element and a axially displaceable driven element, said driven element arranged to move axially responsive to rotation of said driving element and to move said linkage member when moved axially.

3. The skate according to claim 2, wherein said linkage is arranged to move horizontally, whereby said linkage member is parallel to said sole and said retraction mechanism is compact.

4. The skate according to claim 2, wherein said retraction mechanism includes a key for rotating said driving element and where said key is disposed at the exterior of said shoe in a location accessible by hand, such that said key is both accessible and unobtrusive.

5. A retraction mechanism for attachment to a shoe to enable the shoe to be utilized as a skate, said retraction mechanism comprising:

a plurality of wheels a housing for supporting said wheels, said housing having a bottom surface a linkage member operably connected to all of said wheels where said retraction mechanism additionally comprises a ramp fixed in relation to said housing and disposed to guide said wheels along an inclined path having a vertical component of travel and a horizontal component of travel when said wheels are moved by said linkage member; whereby said retraction mechanism may be attached to the shoe and said retractable wheels are simultaneously moved by said linkage member into a deployed position extending below said bottom surface of said housing and, when desired, said linkage member moves said retractable wheels simultaneously into a stowed position above said bottom surface of said housing.

6. The retraction mechanism according to claim 5, wherein said linkage member is arranged to move horizontally, and whereby said linkage member may be mounted parallel to the sole of the shoe associated with said retraction method, thereby rendering said retraction mechanism compact when mounted on the shoe.

7. The retraction mechanism according to claim 5, wherein said retraction mechanism comprises a rotary drive having an axially stationary driving element and an axially displaceable driven element, said axially displaceable driven element arranged to move axially responsive to rotation of said axially stationary driving element thus moving said linkage member when moved axially.

8. The retraction mechanism according to claim 7, wherein said retraction mechanism includes a key for rotating said axially stationary driving element, where said key is disposed at the exterior of said housing in a location accessible by hand, wherein said key is both accessible and unobtrusive.

9. A skate comprising:

a shoe having a sole;

a plurality of retractable wheels retractably mounted to said shoe; and a retraction mechanism mounted to said shoe and having a housing for supporting said wheels, said housing having a bottom surface, and a linkage member operably connected to all of said wheels selectively to retract all of said wheels simultaneously into a stowed position above said bottom surface of said housing and to extend all of said wheels simultaneously into a deployed position extending below said bottom surface of said housing, said retraction mechanism comprising a ramp fixed in relation to said shoe and disposed to guide said wheels along an inclined path having a vertical component of travel and a horizontal component of travel when said wheels are moved by said retraction mechanism, and a rotary drive having an axially stationary driving element and an axially displaceable driven element, said driven element arranged to move axially responsive to rotation of said driving element and to move said linkage member when moved axially, and a key for rotating said driving element, said key disposed at the exterior of said shoe in a location accessible by hand, whereby said key is accessible and unobtrusive, said linkage member arranged to move horizontally, whereby said linkage member is parallel to said sole and said retraction mechanism is compact.

* * * * *